US006131360A

United States Patent [19]

Dalen

[11] Patent Number: 6,131,360

[45] Date of Patent: Oct. 17, 2000

[54] PLASTIC ANCHOR SYSTEM FOR USE WITH MASONRY OVER STEEL STUD BACK-UP WALLS

[75] Inventor: Mark Van Dalen, Nepean, Canada

[73] Assignee: Brook Van Dalen & Associates Limited, Ontario, Canada

[21] Appl. No.: 09/217,971

[22] Filed: Dec. 22, 1998

[51] Int. Cl.[7] ..... E04B 1/38; E04B 2/02

[52] U.S. Cl. ..... 52/712; 52/713; 52/698; 52/407.4; 52/426; 52/513; 52/379; 52/562; 52/565; 52/568

[58] Field of Search ..... 52/712, 713, 714, 52/562, 565, 568, 379, 383, 407.4, 434, 513, 426, 410, 508, 698, 699

[56] References Cited

U.S. PATENT DOCUMENTS

| | | | |
|---|---|---|---|
| 1,052,246 | 2/1913 | Hammons | 52/714 |
| 2,256,961 | 9/1941 | Pearson et al. | 52/407.4 |
| 2,293,743 | 8/1942 | Miles et al. | 52/512 X |
| 3,217,457 | 11/1965 | Naar | 52/565 X |
| 4,056,904 | 11/1977 | Dawdy | 52/434 X |
| 4,835,928 | 6/1989 | Scott | 52/564 X |
| 4,869,043 | 9/1989 | Hatzinikolas et al. | 52/379 X |
| 4,998,397 | 3/1991 | Orton | 52/379 |
| 5,035,099 | 7/1991 | Lapish | 52/565 X |
| 5,207,043 | 5/1993 | McGee et al. | 52/379 |
| 5,347,781 | 9/1994 | Hanlon | 52/379 |
| 5,392,581 | 2/1995 | Hatzinikolas et al. | 52/712 |
| 5,987,830 | 11/1999 | Worley | 52/426 X |

FOREIGN PATENT DOCUMENTS

| | | | |
|---|---|---|---|
| 1486170 | 9/1977 | United Kingdom | 52/513 |
| 2069564 | 8/1981 | United Kingdom | 52/562 |

OTHER PUBLICATIONS

BaileyBrick Connector (two pages)—undated.

Bailey Lightweight Steel Framing Systems (four pages)—printed by Bailey Co., Concord, Ontario.

Blok–Lok Limited (three pages)—printed by Bailey Co. of Canada (address unknown).

Masonary Anchor to Steel Stud Product Information Sheet (one page)—undated.

Canadian Standards Association building code chapter on connectors for masonry; p.39 & p.46—Feb. 1994.

Canada Mortgage & Housing Corp. (CMHC) reference publication, entitled "Brick Veneer on Concrete Masonry or Steel Stud Wall Systems"; p.56, 59, 104, 105, 124, 142, 160, 164, & 166; published 1991 by Canada Mortgage & Housing Corporation.

Seminar on Brick Veneer Wall Systems, Chapter 21, p.21–1 through 21–27, entitled "A Summary Behaviour of Brick Veneer/Steel Stud Tie Systems" seminar presented in Canada in 1989.

Brick Veneer/Steel Stud Wall Design And Construction Practices in Canada—Results of a 1986 Survey; prepared by Suter Keller Inc., Ottawa, Canada in Mar. 1986; p. 13, 14, 22, 33, 67, 80–81.

"Field Investigation of Brick Veneer/Steel Stud Wall Systems"; report prepared by Suter Keller, Inc., of Ottawa, Ontario; p. 9, 10, 18, & 19.

Part 3 of the McMaster University Laboratory Test Program on Brick Veneer/Steel Stud Wall Systems; prepared by R.G. Drysdale, et al.; Dept. of Civil Engineering, McMaster University, Hamilton, Ontario, Canada; May 1990; p.69, 71, 75, 76, 78 & 79.

(List continued on next page.)

*Primary Examiner*—Laura Callo

*Attorney, Agent, or Firm*—Hoffman, Wasson & Gitler

[57] ABSTRACT

An anchor body has an inner portion adapted for connection to a back-up wall, an outer portion adapted for connection to a masonry wall and an intermediate membrane flange. The membrane comes into contact with the membrane flange of the membrane side. The membrane flanges on the anchor insure continuity of the membrane without the need for any additional caulking or other application.

8 Claims, 2 Drawing Sheets

OTHER PUBLICATIONS

DUR–O–WAL "Technical Documentation For Adjustable Veneer Anchor System" Author—DUR–O–WAL, Inc., (pp. 1–6); date unknown.

DUR–O–WAL "New Product Information: D/A 213 Veneer Anchor Assemblies" Author—DUR–O–WAL, Inc., (two pages); 1986.

DUR–O–WAL "Code Approved Masonry Connections for Seismic Conditions and High Wind Loads" Author—DUR–O–WAL Seismic Products (three pages), 1992.

DUR–O–WAL "Your Source Book for Masonry Joint Reinforcement" Author—DUR–O–WAL, Inc. (four pages), date unknown.

"DUR–O–WAL Joint Reinforcement/Connector Detialing and Selection Guide" Author—DUR–O–WAL, Inc., (pp. 1, 2, 5, 6), 1993.

PLASTIC ANCHOR SYSTEM FOR USE WITH MASONRY OVER STEEL STUD BACK-UP WALLS

FIELD OF INVENTION

This invention relates to construction materials, and to an anchor for use with masonry over steel stud back-up walls in particular.

BACKGROUND OF THE INVENTION

In the past, exterior walls of buildings were commonly constructed of solid masonry, involving multiple wythes (or thicknesses) of masonry laid up together. Floor joists were supported in recesses in the inner masonry wythe and floors, room partition walls, and the rest of the inside of the building were supported on these joists. In some cases, insulation was installed between wythes.

In the past few decades, solid masonry wall construction has been replaced by masonry veneer wall construction. For example, in single family residential construction, a frame of a house is constructed, usually of wooden studs, sheathing material is affixed to the outer surface of the studs and a single masonry wythe (often brick) is erected as a veneer outside of the sheathing material. In residential construction, insulating material is most often installed in the space between adjacent wooden studs. The masonry veneer wall is attached to the back-up wall of wood studs using an array of anchors. Each anchor terminates at its outer end as an embedment within the mortar bed between the rows of masonry, placed as the wall is erected. The inner end of each anchor is usually nailed to a wooden stud in the back-up wall framing.

More recently, especially in commercial buildings, the back-up wall to which the masonry veneer is attached has been made of steel studs and some, or all, of the insulating material is installed outboard of the steel stud framing. In this form of masonry veneer construction, the attachment between the studs and the masonry also involves an array of anchors. These anchors are commonly one-piece formed steel, with a slot or set of holes near the outer end of the anchor. In one common form of attachment, the anchor resembles a bayonet that is fastened to the steel stud and pierces the exterior sheathing (and any other materials outboard of the steel stud wall). In such a case the inner surface of each anchor can be screwed or bolted to a steel stud. A bent tie is inserted through slots or holes in the outer end of the anchor and then embedded in the mortar bed between rows of masonry.

SUMMARY OF THE INVENTION

Presently, anchors for masonry veneer over steel stud back-up walls are most commonly made up of a band of steel (a bayonet) that accepts a connecting bent tie. There are two main problems with anchors made of steel. The first problem has to do with the thermal properties of steel. It is an extremely good conductor of heat, and, because of this property, steel anchors draw heat from the inside of a building from their inner attachment surfaces, through the exterior sheathing and insulation, towards the exterior of the masonry wall. The other major shortcoming of steel is that the material corrodes. In damp environments, the steel anchors will corrode over time, thereby weakening the attachment between the exterior masonry and the underlying, and supporting, back-up wall.

Furthermore, current building codes require an air, moisture and vapour barrier within most exterior wall assemblies.

In commercial and some residential construction, designers often use a single membrane applied over the exterior surface of the sheathing to meet this requirement in veneer wall construction with steel stud back-up walls. However, as the membrane is applied on walls using bayonet style anchors, common in the industry today, it must be placed over the bayonets that protrude from the sheathing, thereby piercing the membrane. For the membrane to remain as a functional air, moisture and vapour barrier, mastic/caulking must be applied around each spot where a bayonet pierces the membrane. The mastic/caulking is applied manually and its application is a time consuming process if a proper seal around each bayonet is to be achieved. In reality, it is unlikely that the membrane will be completely sealed once all the caulking is completed. There are many potential spots along a wall where the caulking may not be properly applied, resulting in openings in the air, moisture and vapour barrier.

The present invention addresses the major shortcomings of the prior art. Firstly, the anchor is constructed of plastic, or fibre reinforced plastic, which addresses the thermal conductivity and corrosiveness issues. Plastic has a much lower thermal conductivity than steel, so less heat is lost through plastic anchors. In addition, plastic does not corrode or deteriorate under normal environmental conditions. Secondly, the bayonet design of current anchors is replaced by an anchor body, and an intermediate membrane flange. Typically, exterior sheathing is first attached to the studs of a back-up wall. An array of slots is then cut through the sheathing from the interior, with each slot carefully aligned with the side of a stud. An anchor body is then inserted, through each slot in the exterior sheathing, from the exterior. Each anchor body is fastened to a stud in the usual fashion. A membrane flange, integral with the anchor body, rests flush against the outer surface of the exterior sheathing. When a membrane is placed over the exterior sheathing, the membrane is pierced by each anchor body. The membrane, once it is pressed towards the exterior sheathing, comes in contact with the membrane flange on the membrane's inner side. As the membrane flange is integral with the anchor body, the membrane seals onto a membrane flange at each point where it is pierced by an anchor body. The membrane flanges on the array of anchors on a wall ensure continuity of the membrane without the need for any additional mastic/caulking application.

The present anchor system is useful in that it performs the function of what is currently in use to anchor masonry veneer walls to a supporting back-up wall while lessening the heat transfer through anchors, eliminating the risk of deterioration of the anchors through corrosion, and improving the integrity of a membrane barrier applied over the exterior sheathing.

An object of the present invention is to provide an anchor body for use as a component of an anchor system, the anchor body being an improvement on presently existing anchor systems. An object of the present invention is to provide an anchor body whose components are economical to manufacture and that is simple to install. An object of the present invention is to provide for an anchor body which is made up of an inner portion which is adapted for connection to a back-up wall, an outer portion which is adapted for connection to a masonry wall, and an intermediate membrane flange.

According to one broad aspect of the present invention, there is provided, an anchor body made up of an inner portion adapted for connection to a back-up wall, an outer portion adapted for connection to a masonry wall, and an intermediate membrane flange.

BRIEF DESCRIPTION OF THE DRAWINGS

Preferred embodiments of the present invention will be further described with the aid of the following drawings in which.

DETAILED DESCRIPTION OF THE PREFERRED EMBODIMENT

Figure 1:
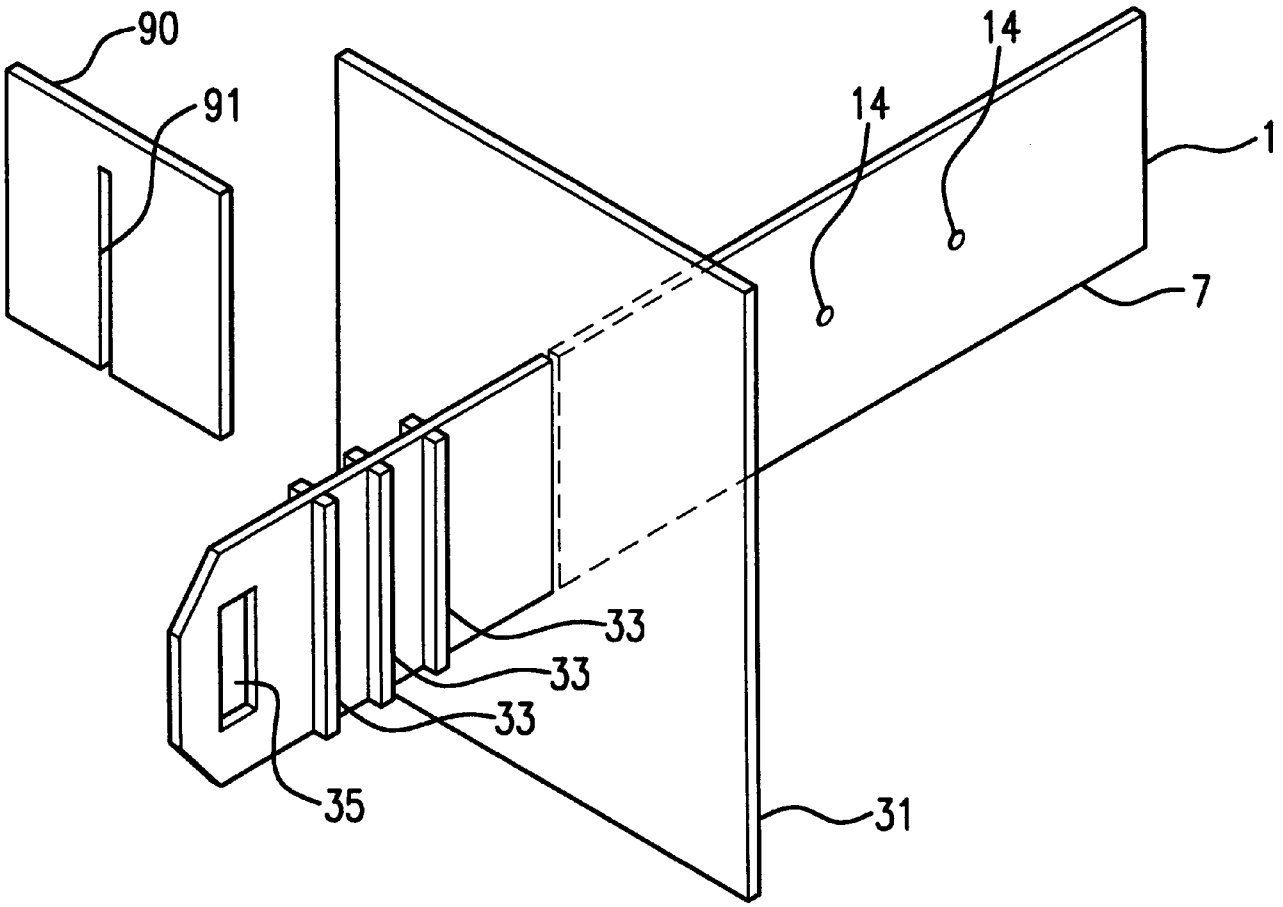
FIG. 1 is a perspective view illustrating the present anchor system.
Figure 2:
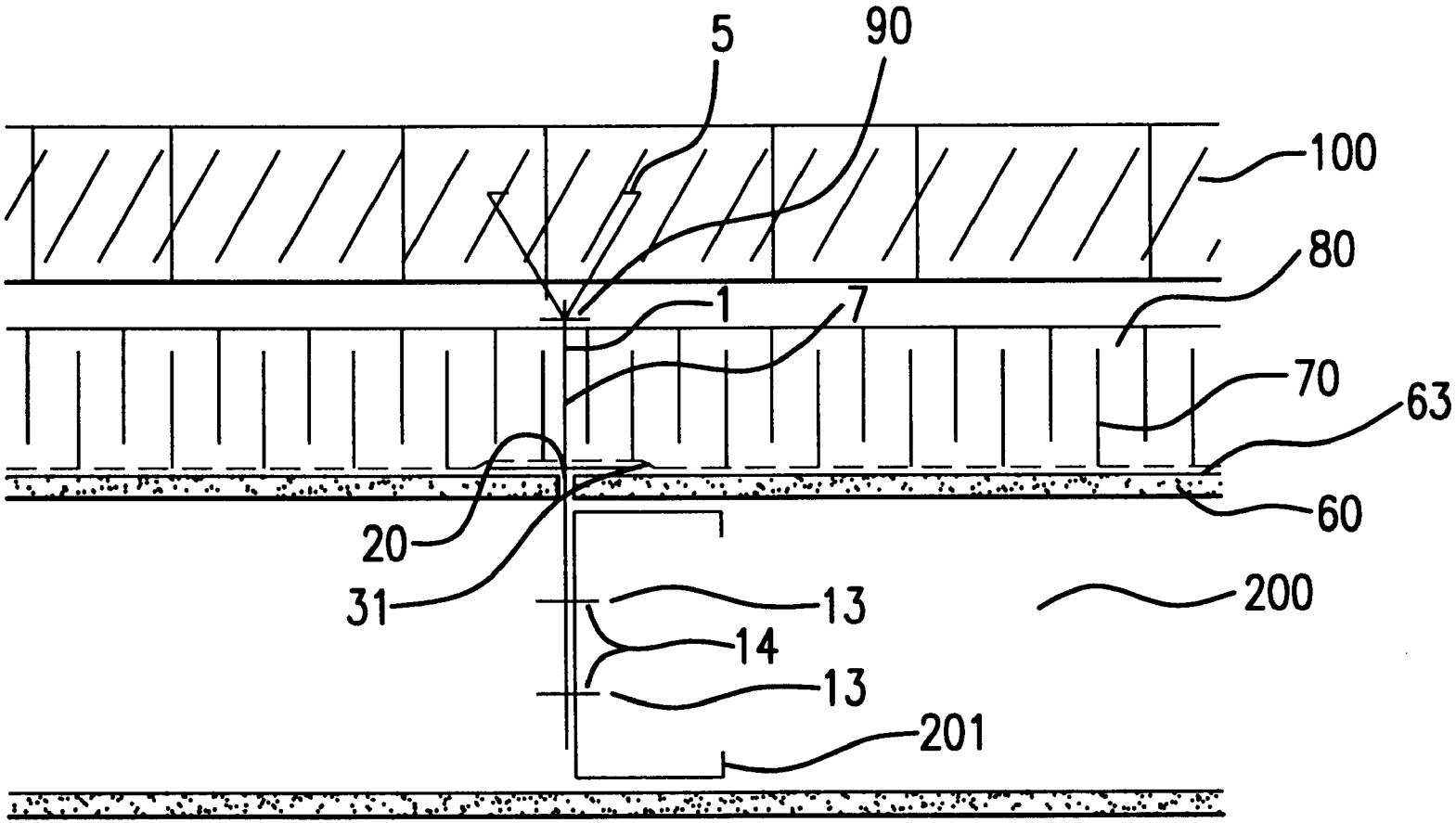
FIG. 2 is a top plan view illustrating how the present anchor system attaches a stud to an exterior brick veneer wall.

Anchor 1 consists of a bent tie 5, and an anchor body 7.

Anchor body 7 is constructed of plastic or fibre reinforced plastic. The plastic or fibre reinforced plastic material is strong enough to hold a masonry wall 100 to a back-up wall or building frame 200 made up of studs 201 when anchors 1 are installed between a masonry wall 100 and a frame 200 in a regular grid pattern. This pattern is usually set in accordance with applicable codes and standards and is quite often at a density of one anchor 1 every twenty-four inches, centre to centre, along the length of wall 100 and one anchor 1 every twenty-four inches, centre to centre, along the height of wall 100. The plastic or fibre reinforced plastic is not only strong, but must be heat and cold resistant and must be resistant to deterioration over time.

Exterior sheathing 60 is secured to frame 200 with standard fasteners such as screws or nails which are driven into studs 201. Once the exterior sheathing 60 is installed on frame 200, an array of slots is cut through the sheathing from the interior, with each slot aligned with the side of a stud. From the exterior, an anchor body 7 is inserted through a slot 20 in the sheathing 60. Anchor body 7 is fastened on a stud 201 using any suitable fastening means, such as screws, bolts or rivets. For simplicity, a pair of screws 13 fitted through screw holes 14 is illustrated here.

Anchor body 7 would be available in different sizes to accommodate different thicknesses of exterior sheathing 60 and different sizes of studs 201.

Anchor body 7 is fitted with an integral membrane flange 31 such that membrane flange 31 will rest flush against the outer surface 63 of the exterior sheathing 60 once an anchor body 7 is fully inserted in the sheathing slot 20. Alternatively, membrane flange 31 may be a separate piece which attaches to anchor body 7 through a conventional means such as a press fit or a snap fit, rather than being integral with anchor body 7. A membrane 70 is then applied over the outer surface 63 of the exterior sheathing 60 and is simply lapped and sealed onto membrane flange 31 at each anchor body 7. There is no need to seal membrane 70 with mastic or caulking to the portion of each anchor body 7 which projects orthogonally from the outer surface 63 of the exterior sheathing 60, as is the case with the bayonet portion of the prior art anchors.

Insulation 80 can be impaled over the projecting portions of the anchor bodies 7, and the insulation 80 can be held in place on the anchor bodies by sliding slot 91 in insulation retention plate 90 over anchor body 7 at the most appropriate of a series of mating vertical ridges 33 in the anchor body 7, depending on the thickness of insulation 80. A bent tie 5 is inserted through punched slots or holes 35 in the terminal end of anchor body 7. The terminal ends of bent tie 5 are embedded in the mortar bed of masonry wall 100.

Several variations of the invention described will be understood by one skilled in the art to come in the scope of the present invention. The only limitations on the scope of the present invention intended by the inventor are the following, attached claims.

I claim:

1. An anchor body for connecting an inner back-up wall made up of exterior sheathing affixed to a frame of studs and an outer masonry wall, said anchor body comprising:

a) an inner portion shaped to protrude through a slot cut in the exterior sheathing of the inner back-up wall, said inner portion also adapted to be fastened to a stud within the back-up wall;

b) an outer portion having a terminal end adapted for connection to the masonry wall; and c) a membrane flange between and integral with said inner portion and said outer portion, said membrane flange extending outwardly from said inner and outer portions in all directions to define an inner surface to sit flush against the exterior sheathing of the back-up wall when said inner portion is fastened to a stud within, and an outer surface against which a membrane applied to the exterior sheathing may be lapped and sealed all around said outer portion of said anchor body.

2. The anchor body of claim 1 wherein the membrane flange is an integral component of the anchor body.

3. The anchor body of claim 2 in which the anchor body and the membrane flange are made of plastic or fibre re-inforced plastic.

4. The anchor body of claim 1 in which the anchor body and the membrane flange are made of plastic or fibre re-inforced plastic.

5. The anchor body of claim 1 wherein the inner portion is adapted to be fastened to a side face of said stud within the back-up wall.

6. The anchor body of claim 5 wherein the outer portion of the anchor body is fitted with at least one vertical ridge, over which an insulation retention plate may be inserted.

7. The anchor body of claim 6 in which the anchor body and the membrane flange are made of plastic or fiber reinforced plastic.

8. The anchor body of claim 5 in which the anchor body and the membrane flange are made of plastic or fibre re-inforced plastic.

* * * * *